US006142817A

United States Patent [19]

Lee

[11] Patent Number: 6,142,817

[45] **Date of Patent: *Nov. 7, 2000**

[54] INSULATION DISPLACEMENT CONNECTOR

[75] Inventor: Jane X. Lee, Bloomingdale, Ill.

[73] Assignee: Marconi Communications Inc., Cleveland, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 09/030,564

[22] Filed: Feb. 25, 1998

Related U.S. Application Data

[60] Provisional application No. 60/040,079, Mar. 7, 1997.

[51] Int. Cl.[7] ..... H01R 4/26

[52] U.S. Cl. ..... 439/395; 439/404

[58] Field of Search ..... 439/395, 396, 439/400, 401, 402, 403, 405, 404

[56] References Cited

U.S. PATENT DOCUMENTS

| | | | |
|---|---|---|---|
| 3,605,071 | 9/1971 | Sedlacek . | |
| 3,636,500 | 1/1972 | Sedlacek . | |
| 3,761,866 | 9/1973 | Sedlacek . | |
| 3,957,335 | 5/1976 | Troy . | |
| 4,059,331 | 11/1977 | Sedlacek et al. . | |
| 4,106,837 | 8/1978 | Paluch . | |
| 4,160,880 | 7/1979 | Brey . | |
| 4,325,100 | 4/1982 | Baumbach . | |
| 4,331,839 | 5/1982 | Baumbach . | |
| 4,652,070 | 3/1987 | Suffi . | |
| 4,846,726 | 7/1989 | Pala | 439/492 |
| 4,919,622 | 4/1990 | Suffi . | |
| 5,004,426 | 4/1991 | Barnett | 439/82 |
| 5,127,845 | 7/1992 | Ayer et al. . | |
| 5,139,440 | 8/1992 | Volk et al. . | |
| 5,302,137 | 4/1994 | Suffi . | |
| 5,324,211 | 6/1994 | Siemon et al. | 439/404 |
| 5,514,005 | 5/1996 | Jaycox et al. . | |
| 5,556,296 | 9/1996 | Dussausse et al. | 439/404 |
| 5,685,733 | 11/1997 | Janczak | 439/395 |
| 5,759,061 | 6/1998 | Jensen et al. | 439/402 |

OTHER PUBLICATIONS

"Mass Wire insulation Displacing Termination of Flat Cable" by Donald J. Doty and George A. Patton of AMP Incorporated. (pp. 127–134) (no date).

"Evaluation of Insulation Displacement Technology for use in the British Telecommunications System" by H.E. Hines, Nemours Telecom Research Laboratories, Martlesham, Ipswich, England (pp. 99–108) (no date).

"An Evaluation of the Insulation Displacement Electrical Contact" by N. K. Mitra, Berg Electronics Division, Du Pont De Nemours (Netherland) B.V. 's–Hertogenbosch, The Netherlands (pp. 99–108) (no date).

"Contact Force Anaylsis of Slotted Beam Connectors" by Sujan Dasgupta (pp. 153–158) from the IEEE Transactions on Components, Hybrids and Manufacturing Technology–vol. CHMT–5, No. 1, Mar. 1982.

"Cutting Force Anaylsis of Split Beam Connectors" by Sujian Dasgupta (pp. 180–185) from the IEEE Transctions on Components, Hybrids and Manufacturing Technology – vol. CHMT–5, No. Mar. 1992.

"A Unique Method to Measure the Loading Characteristics of Insulated Wire as it is Inserted into a Slot" by R.D. Malucci, AMP Incorporated, Harrisburg, PA (pp. 153–158) (no date).

(List continued on next page.)

*Primary Examiner*—Lincoln Donovan
*Attorney, Agent, or Firm*—Jones, Day, Reavis & Pogue

[57] ABSTRACT

A conductive terminal for receiving a conductor is disclosed. The terminal includes a base and two resilient beams extending from the base. Generally distal the base, the beams define a mouth for receiving the conductor. The beams have facing inner edges which define a slot extending from the mouth. The beams define a generally egg-shaped aperture in an area extending between the slot and the base.

15 Claims, 5 Drawing Sheets

OTHER PUBLICATIONS

"Design Method fro Slotted Beam Springs for Insulation Displacement Contacts" C.G.M. van Kessel and J. H. Glashorster (pp. 408–413) from the IEEE Transactions on Components, Hybrids and Manufacturing Technology –vol. CHMT–6, No. 4, Dec. 1983.

Paper entitled "Insulation Displacement Connection Reliability" by R.A. Wandmacher published inthe proceedings of the 1986 Connector and Interconnector Technology Symposium. (Appendix A of Zierick Manufacturing Torsion IDC Reliability intro.) (no date).

Paper entitled "A New type of Very High Reliability Torsion IDC which can Accept a Large range of Wire Gauges" by Janos Legrady, 1989 Symposium's proceedings of the International Institute of Connector and Interconnection Technology Inc. (Appendix B of Zierick Manufacturing Torsion IDC Reliability Into.) (no date).

INSULATION DISPLACEMENT CONNECTOR

RELATED APPLICATION

The application claims the benefit of U.S. Provisional Application Ser. No. 60/040,079, filed Mar. 7, 1997.

BACKGROUND

Insulation Displacement Connectors (IDC) are a widely used connection technology in the communication industry. An IDC connector or clip performs two functions: severing or splitting plastic insulation surrounding a conductive wire to provide access to the conductive wire thereunder and frictionally engaging and/or compressing the conductive wire to provide electrical contact. In the design of an IDC clip, numerous variables must be considered in order to provide optimal clip design to achieve desired operating characteristics. As a general background, it is desirable to have an IDC clip which displaces the insulation, deforms the conductive wire and does not cut the conductive wire. Also, it is desirable to have an IDC clip which maintains a desired pressure on the deformed conductive wire and forms a contact area of a desired size. Further, it is desirable to provide stress distribution throughout the clip structure such that the conductive wire can be repeatedly terminated and disengaged therewith without the clip failing. Additionally, in the present communication industry, it is important to reduce the costs associated with the equipment. As such, the material cost and manufacturing costs associated with the IDC clip must be minimized.

Prior art IDC clips generally provide symmetric clip structures which function well but are not necessarily optimized. Examples of prior art IDC clips are provided in FIGS. 5–8. Typically, prior art IDC clips use a design and analysis method known as "beam" theory. The resulting arms or "beams" of the IDC clip define a generally symmetric aperture therebetween. The aperture between the beams allow for a degree of flexion or torquing of the beams relative to one another. One of the problems with the prior art design is that the symmetric aperture does not necessarily optimize the stress distribution of the beams and thus does not optimize the operating characteristics of the IDC clip. With regard to the "symmetric" structure, the reference is made to this term such that the aperture is symmetric top to bottom, left to right. For example, one prior art IDC clip design (see, FIGS. 7–9) includes an aperture which is generally an elongated opening having parallel side walls and a gap dimension between the bottom portion of the side walls and the top portion of the side walls being generally equal. While this construction functions sufficiently under a variety of circumstances it was not necessarily optimized for other applications.

OBJECTS AND SUMMARY

A general object envisioned by the present invention is to provide a conductive terminal for receiving a wire conductor where the conductive terminal provides desirable stress distribution during engagement with the wire conductor.

Another object envisioned by the present invention is to provide a conductive terminal for receiving a wire conductor where the conductive terminal can be repeatedly terminated and disengaged with the wire conductor without the conductive terminal failing.

Yet another object envisioned by the present invention is to provide a conductive terminal for receiving a wire conductor where the conductive terminal has relatively low material cost and manufacturing costs associated therewith yet is reliable and can repeatably make termination without failure.

Briefly, and in accordance with the foregoing, the present invention provides a conductive terminal for receiving a conductor. The terminal includes a base and two resilient beams extending from the base. Generally distal the base, the beams define a mouth for receiving the conductor. The beams have facing inner edges which define a slot extending from the mouth. The beams define a generally egg-shaped aperture in an area between the slot and the base.

BRIEF DESCRIPTION OF THE DRAWINGS

The organization and manner of the structure and function of the invention, together with the further objects and advantages thereof, may be understood by reference to the following description taken in connection with the accompanying drawings, wherein like reference numerals identify like elements, and in which.

DESCRIPTION

Figure 1:
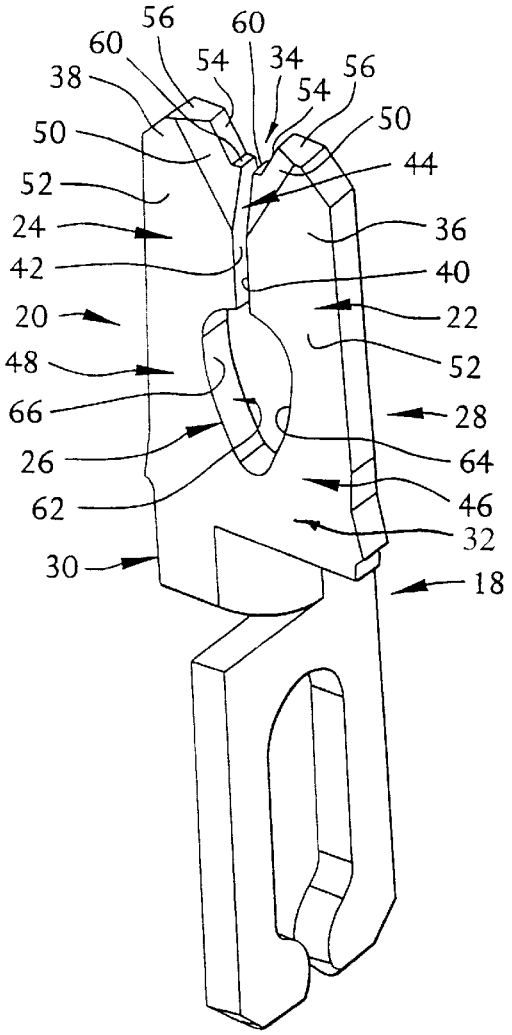
FIG. 1 is a front, right-side, top perspective view of an insulation displacement connector (IDC) in accordance with the present invention, attached to a half-tap connector.

While the present invention may be susceptible to embodiment in different forms, there is shown in the drawings, and herein will be described in detail, an embodiment with the understanding that the present description is to be considered an exemplification of the principles of the invention and is not intended to limit the invention to that as illustrated and described herein.

Figure 2:
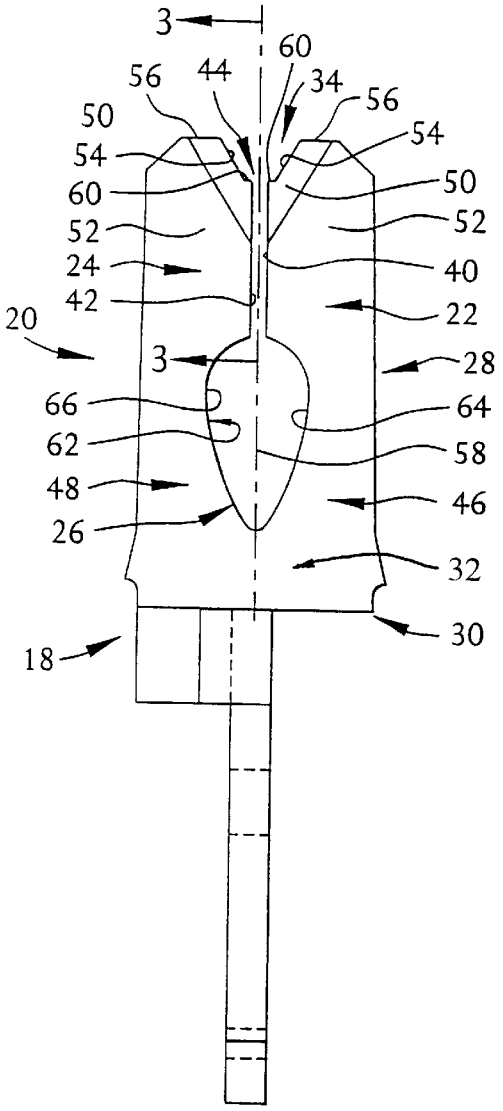
FIG. 2 is a front elevational view of the IDC of FIG. 1.
Figure 3:
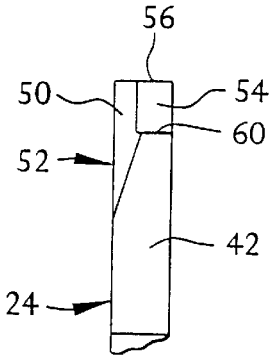
FIG. 3 is an enlarged, partial fragmentary, side-elevational view of an upper portion of a beam of the IDC of FIG. 1, taken along line 3—3 of FIG. 2.
Figure 4:
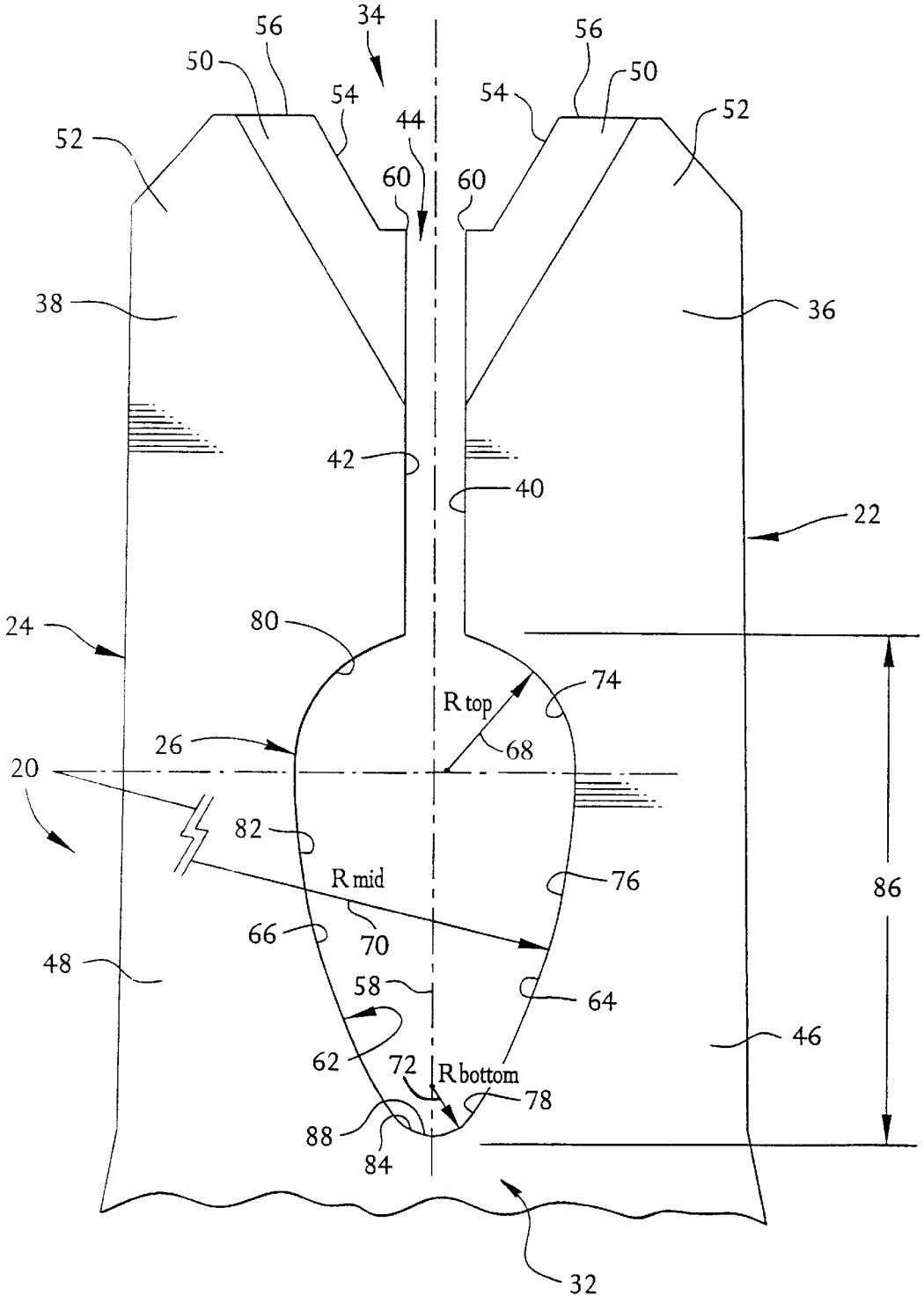
FIG. 4 is an enlarged, partial fragmentary, front-elevational view of the IDC of FIG. 1.

Shown in FIGS. 1 and 2 is a conductive terminal commonly referred to a half-tap connector 18 employing an insulation displacement connector (IDC) 20 in accordance with the present invention. FIGS. 3 and 4 show portions of the IDC 20 shown in FIGS. 1 and 2. While a conductive terminal 18 is shown as a half-tap connector, the IDC 20 may be used on a variety of other conductive terminal structures. The IDC 20 of the present invention has a novel configuration of neighboring, substantially parallel resilient beams or arms 22, 24 with a generally non-circular, egg-shaped aperture 26 defined therebetween.

Generally, when a conductor such as a conductive wire is inserted between the beams 22, 24, the IDC 20 preferably pierces or severs an outer insulating layer surrounding an inner conductor and frictionally engages or compresses the inner conductor to establish electrical contact therewith. The present invention provides a novel connector with optimized IDC 20 geometry and stress distribution under loading. The mechanical properties of the IDC 20 in accordance with the present invention facilitate reliable and repeatable termination for a predetermined range of insulated wire sizes. Also, the IDC 20 of the present invention is rather dimension insensitive such that it can be fabricated to small dimensions, if necessary, and still retain the mechanical benefits of the overall design.

With reference to FIGS. 1 and 2, the IDC 20 is formed of a body 30 including a base 32 with the two resilient beams 22, 24 extending therefrom. The beams 22, 24 are preferably two substantially parallel resilient cantilever beams. A mouth 34 is defined at the end of the beams 22, 24, generally distal the base 32 for initially receiving the conductor. An upper portion 36, 3 8 of the beams 22, 24 have generally facing, inner edges 40, 42 which define a gap or slot 44 therebetween, and the slot 44 extends from the mouth 34 to the aperture 26. The egg-shaped aperture 26 is defined between lower portions 46, 48 of the beams 22, 24, respectively, adjacent the slot 44. The aperture 26 is thus formed in an area extending between the slot 44 and the base 32.

When a conductor such as a conductive wire is engaged with the IDC 20, the conductor is inserted through the mouth 34 into the slot 44 between the beams 22, 24. Insertion of a wire into an IDC generally is well known in the art such that the IDC will sever an insulating jacket of the wire and engage the conductive inner portion of the wire. As shown in FIGS. 1–4, beveled surfaces 50 are provided on either side of the wire receiving mouth 34, angled inwardly from a face surface 52 of the beams 22, 24. Sides 54 of the mouth 34 are also angled inwardly from a top edge 56 of the beams 22, 24 towards a central axis 58. The angled surfaces 50, 54 help to guide the wire conductor into the slot 44. Edges 60 adjacent the generally facing, inner edges 40, 42 defining the slot 44 help cut through the outer insulating layer but preferably do not cut the inner conductor. As can be seen in FIG. 3, the angled surfaces 50, 54 and inner edges 40, 42 are generally planar surfaces which do not terminate in a pointed tip. As such, these planar surfaces tend to merely deform the inner conductor material as opposed to cutting the material.

With further reference to the enlarged, partially fragmentary, front-elevational view of the IDC 20 as shown in FIG. 4, it can be seen that the aperture 26 defined between the beams 22, 24 is non-circular and is generally referred to herein as "egg-shaped". The egg-shaped aperture 26 is formed by a generally continuous arcuate aperture edge 62 extending from the inner edges 40, 42 and extending along each beam 22, 24 and joining the beams 22, 24 at the base 32 of the IDC 20. The aperture 26 is symmetrical about the central axis 58 which is coincident with the major axis of the egg-shaped aperture, and a line 59 perpendicular to the central axis is designated a minor axis of the egg-shaped aperture. The minor axis is drawn approximately through the widest dimension of the egg-shaped aperture but is otherwise located arbitrarily.

The aperture edge 62 has two generally edge halves 64, 66 which join at the base 32. Each edge half 64, 66 is defined by three different radii, shown herein by radial indicators 68, 70 and 72. In the interest of clarity in describing the invention, only the radial indicators associated with one edge half 64 of the edge 62 are shown and it is understood that the description of one half is representative of both edge halves 64, 66. The halves 64, 66 mirror each other and are symmetric about the central axis 58, and therefore so do the radii 68, 70 and 72 of each half 64 and 66 of the arcuate edge 62.

Edge half 64 is formed by three edge portions 74, 76 and 78, and half 66 is formed by three corresponding edge portions 80, 82 and 84. a first edge portion 74 of half 64 of the edge 62 is adjacent the slot 44 and is defined by a top radius 68 ($R_{top}$ in FIG. 4). The top radius 68 is sized and dimensioned to provide that the first edge portion 74 of half 64 is generally continuous and generally arcuate with the adjacent, second edge portion 76 of half 64. Likewise, the second edge portion 76 is defined by a mid-radius 70 ($R_{mid}$ in FIG. 4) which is sized and dimensioned to provide that the second edge portion 76 is generally continuous and generally arcuate with an adjacent, third edge portion 78.

As shown, edge portion 74 of half 64 is essentially a mirror image of edge portion 80 of half 66, and edge portion 76 of half 64 is essentially a mirror image of edge portion 82 of half 66. The third edge portion 78 of half 64 is defined by a bottom radius 72 ($R_{bottom}$ in FIG. 4) which is sized and dimensioned to provide that the third edge portion 78 is generally continuous and generally arcuate with edge portion 84 of half 66. Edge portion 78 of half 64 is also essentially a mirror image of edge portion 84 of half 66.

As mentioned above, edge half 64 of edge 62 is essentially a mirror image of the other edge half 66. Therefore, edge portion 80 is defined by a radius generally identical to that of radius 68 defining edge portion 74. Likewise, edge portion 82 is defined by a radius generally identical to that of radius 70 defining edge portion 76. Finally, edge portion 84 is defined by a radius generally identical to that of radius 72 defining edge portion 78.

The egg-shaped aperture 26 is defined by the top, mid and bottom radii 68, 70, 72 and an additional variable in the form of a height dimension 86 which, when combined with the radii 68, 70, 72, control the overall shape of the aperture 26. A relationship is defined by the present invention 20 such that the mid-radius 70 is greater than the top radius 68 which is greater than the bottom radius 72 or in other words, $R_{mid}(70)>R_{top}(68)>R_{bottom}(72)$. As seen in FIG. 4, the top radius 68 may extend from the minor axis 59 slightly to the right of the central axis 58 to define the first edge portion 74, while the larger mid-radius 70 may extend from the minor axis 59 far to the left of the central axis 58 to define the second edge portion 76. Finally, the small bottom radius 72 may extend form the central axis 58 below the minor axis 59 to define the third edge portion 78. Preferred ratios for these radii are as follows:

$$0.05<R_{top}(68)/R_{mid}(70)<0.28;$$

$$1.3<R_{top}(68)/R_{bottom}(72)<4.3;$$

and $$0.1<R_{top}(68)/\text{height}(86)<0.35.$$

As described, the arcuate edge 62 defining the aperture 26 is composed of three pairs of different radii 68, 70, 72 symmetrically arranged along each beam 22, 24. This provides that the aperture 26 between the beams 22, 24 is generally symmetrical about the central longitudinal or major axis 58 of the IDC 20 but is not symmetrical about the minor axis 59. As can be seen from the figures, the first edge portions 74, 80 are positioned along the aperture edge 62 opposite one another. Similarly, the second edge portions 76, 82 are positioned opposite each other along the edge 62 and the third edge portions 78, 84 are likewise positioned opposite each other.

The IDC 20 of the present invention has been verified through finite element analysis which indicates that the aperture 26 defined by arcuate portions 74, 76, 78 and 80, 82, 84 corresponding to the radii 68, 70, 72, respectively, is capable of handling heavy bending loads. The advantage of the geometry defined by the arcuate portions 74, 76, 78 and 80, 82, 84 over prior art IDC connectors is that the present invention minimizes stress concentration at the bottom area 88 of the aperture 26 where the beams 22, 24 join at the base 32. The IDC 20 of the present invention spreads out the bending load along the arcuate portions 74, 76, 78 and 80, 82, 84 to optimize stress distribution.

The aperture 26 of the IDC 20 has been specifically described herein with reference to the specific preferred radii and arcuate edges thereof. However, one skilled in the art may recognize other non-circular and egg-shaped apertures which accomplish a similar result (i.e. efficient stress distribution) of directing the stress concentration from any one specific area of the IDC. As a result, the present invention is not meant to be limited to the specific aperture 26 and arcuate edge 62 depicted and described herein, and the edge 62, and therefore the aperture 26 defined thereby, may take other shapes.

In prior art IDC structure, when a wire is engaged with the IDC, high bending stresses concentrate at the bottom portion of the aperture where the beams join each other. These high stresses cause the prior art IDCs to yield and fail to perform proper wire termination. When the prior art IDC yields at the comers and fails to complete a proper wire termination, the stress at other locations along the beams are typically well below the yield point of the material. As such, prior art IDC connectors do not optimize the mechanical properties of the IDC structure.

In contrast, the IDC 20 of the present invention optimizes stress distribution under loading and optimizes the mechanical properties of the IDC material and structure. As a result, the IDC connector 20 of the present invention is rather dimension insensitive and can be fabricated to be much smaller (for example, 50% smaller) than a comparable prior art IDC used to terminate the same, or even a smaller, range of wire sizes, using the same material for the IDC connector. As such, the present invention minimizes the size and material costs yet improves the reliability and repeatability of the IDC to make termination without failure. Consequently, the density of the IDC connectors can be increased within a given area while still being capable of terminating a broad range of wire sizes. As such a plurality of pairs of resilient beams 22, 24 can be produced extending from a common base 32. This would allow interconnectivity of the conductor connected with respective pairs of beams.

Figure 5:
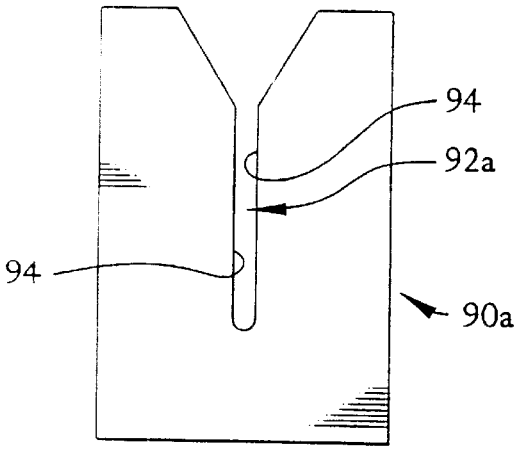
FIG. 5 PRIOR ART
FIGS. 5–8 are representative illustrations of prior art IDC configurations.
Figure 6:
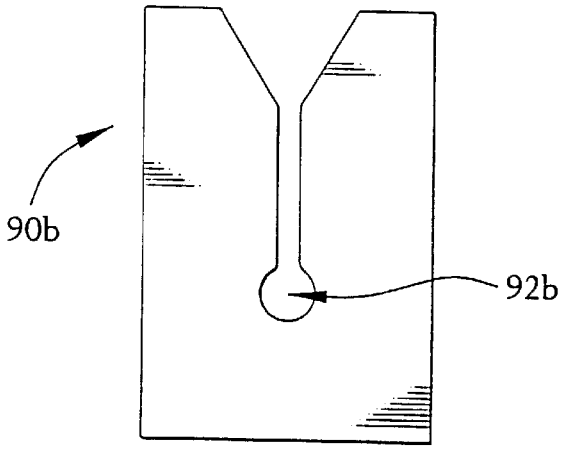
FIG. 6 PRIOR ART
Figure 7:
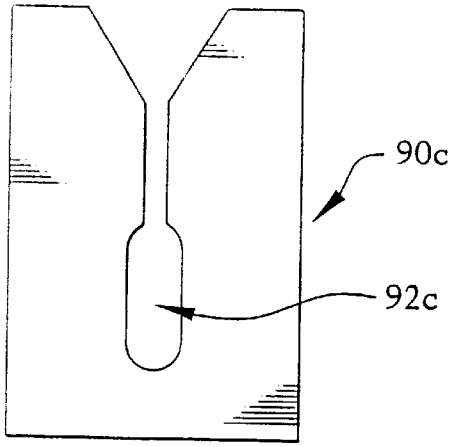
FIG. 7 PRIOR ART
Figure 8:
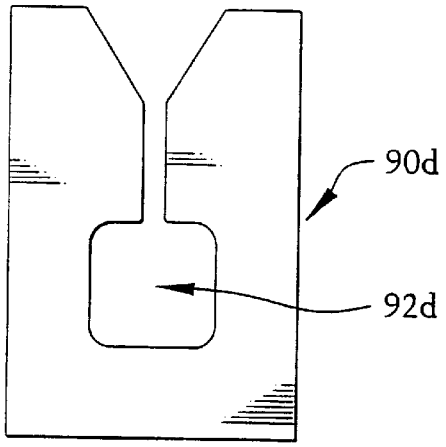
FIG. 8 PRIOR ART
Figure 9:
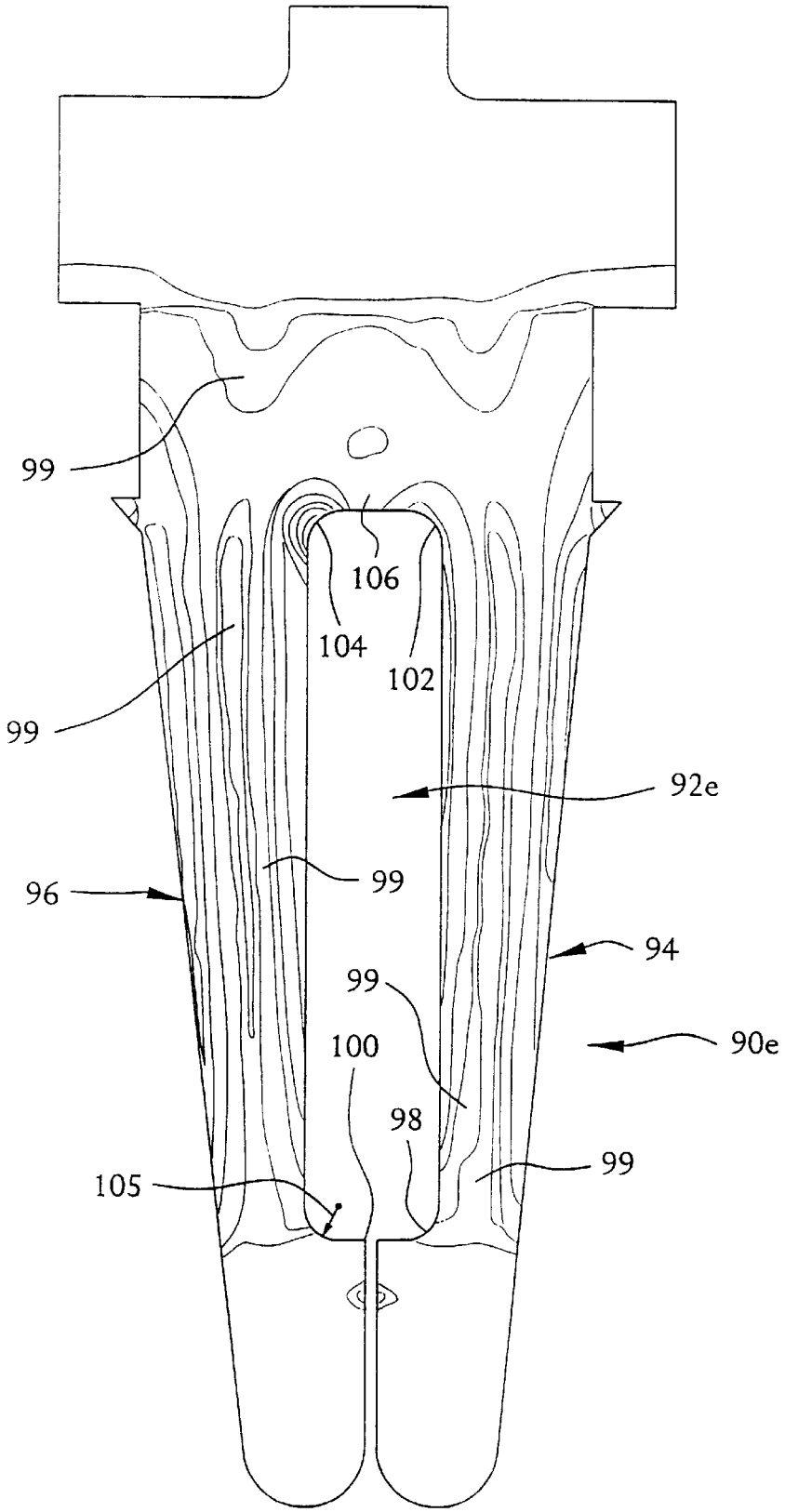
FIG. 9 is a finite element analysis stress distribution contour diagram of a prior art IDC connector.

FIGS. 5–8 are provided to show common shapes of apertures used in association with prior art IDC connectors. Specifically, FIG. 5 depicts an IDC 90*a* with an elongate aperture 92*a* formed by long, parallel walls 94, FIG. 6 depicts an IDC 90*b* with a circular aperture 92*b*, FIG. 7 depicts an IDC 90*c* with a generally oval aperture 92*c* and FIG. 8 depicts an IDC 90*d* with a square aperture 92*d*. FIG. 9 depicts yet another prior art IDC structure 90*e* having an elongated generally rectangular aperture 92*e*. These common forms encounter all of the problems noted hereinabove as the corresponding apertures have not been optimized for wire termination.

Figure 10:
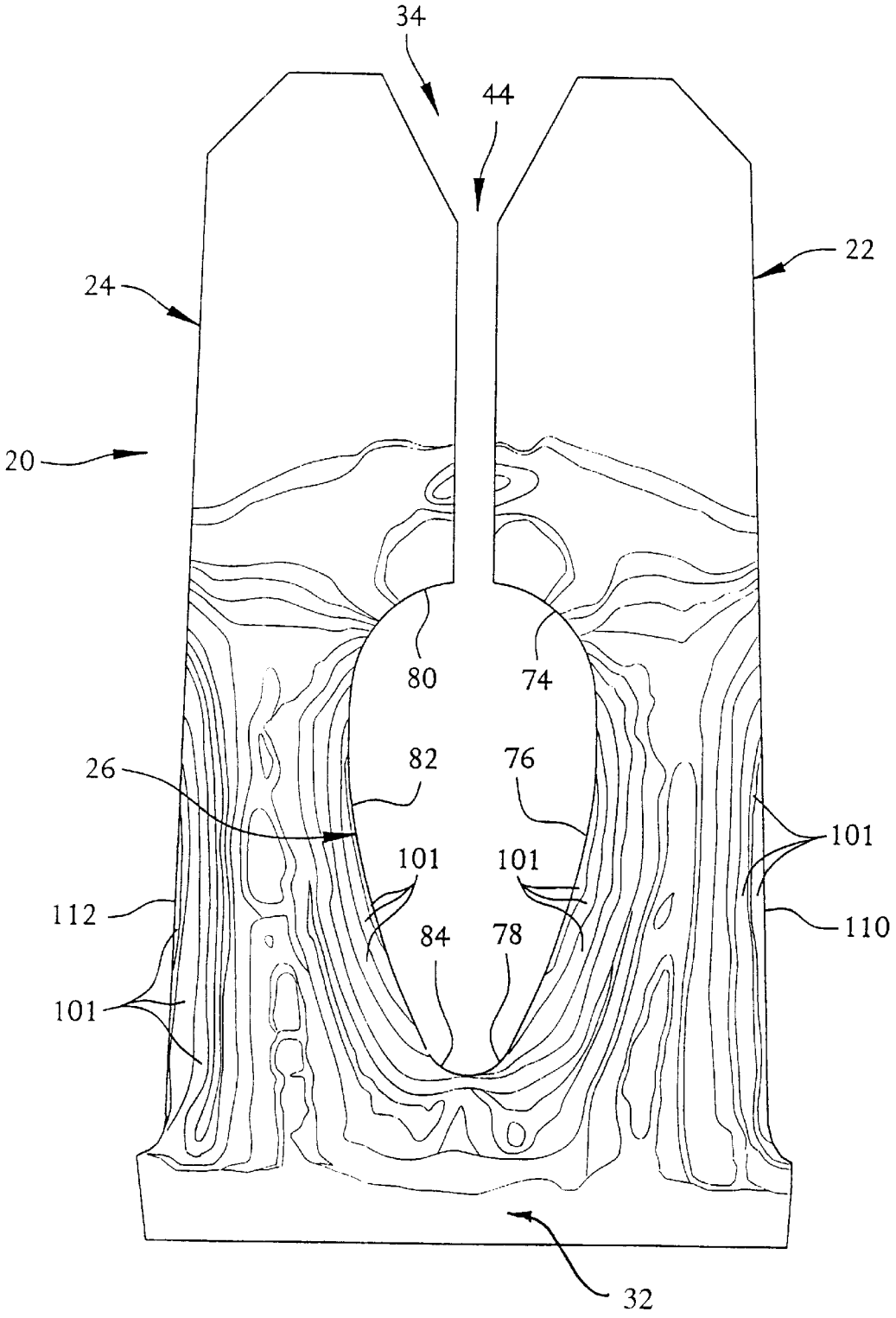
FIG. 10 is a finite element analysis stress distribution contour diagram of the IDC of the present invention.

FIGS. 9 and 10 are finite element analysis stress distribution contours which show comparative stress distribution for prior art IDC structure 90*e* and the IDC structure 20 of the present invention, respectively. As shown in FIG. 9, prior art IDC 90*e* is constructed with two beams 94, 96 which define the elongated generally rectangular aperture 92*e* therebetween. Comers 98, 100, 102, 104 of the aperture 92*e* have small radii 105. As a result, the stress distribution calculations indicate that areas of high stress are concentrated in the lower comers 102, 104 of the aperture 92*e*, as well as at a termination point 106 in the aperture 92*e*. Throughout the other areas of the beams 94, 96, such as at the areas which are identified by the reference numeral 99, the stress levels are generally very low.

In contrast, with reference to FIG. 10, the stress distribution in the IDC structure 20 is distributed over broad areas of the arcuate portions 74, 76, 78, 80, 82, and 84 defining the aperture 26. Preferably, higher levels of stress are concentrated in areas such as those areas which are identified by the reference numeral 101 and along the arcuate portions 76 and 82 defined by the mid-radius 70 (see FIG. 4) which also has the greatest radial dimension. As such, the stress is distributed over a broader area, thereby minimizing stress concentration in any given area of the IDC structure 20. Additionally, stress is also distributed along outer edges 110, 112, of the beams 22, 24, respectively. As such, the stress is distributed over wide areas of the beams 22, 24. Additionally, very little stress is applied in the material of the slot 44.

Another important consideration of the IDC structure 20 of the present invention is that while the insulation is cut, the material of the central conductor is not. Rather, the material of the conductor is deformed and displaced so as to provide greater contact surface area for making the conductive connection. Also, deformation and displacement of the conductor material prevents degrading the conductor strength. In contrast, the prior art tends to cut at least a portion of the conductor material and may not optimize the conductive connection between the IDC structure and the conductive wire.

While a preferred embodiment of the present invention is shown and described, it is envisioned that those skilled in the art may devise various modifications of the present invention without departing from the spirit and scope of the appended claims. For example, the aperture 26 and edge 62 defining same may vary from that which is depicted and described herein. Therefore, the invention is not intended to be limited by the foregoing disclosure.

What is claimed is:

1. A conductive terminal for receiving a conductor, said terminal comprising:

a base; and a pair of resilient beams extending from said base, said beams defining a mouth at an end thereof for receiving the conductor and for providing a force normal to the conductor, said beams having facing inner edges defining a slot extending from said mouth toward said base and an egg-shaped aperture between said slot and said base and defined by said beams, said slot opening to said aperture and said egg-shaped aperture being structured and dimensioned to provide a predetermined stress distribution in the beams, said egg-shaped aperture being symmetrical about a central longitudinal axis of said terminal and being asymmetrical about an axis perpendicular to said central longitudinal axis, said central longitudinal axis dividing said egg-shaped aperture into two halves, each half of said egg-shaped aperture being defined by an arcuate edge along a corresponding one of said pair of beams, said arcuate edge being defined by a plurality of radii, wherein said radii defining said arcuate edge of each half of said egg-shaped aperture are symmetrical about said central longitudinal axis with respect to the radii defining said arcuate edge of the other half of said egg-shaped aperture, wherein a majority of said radii commence in said aperture and a minority of said radii commence outside said aperture.

2. A terminal as recited in claim 1, said egg-shaped aperture defining a continuous arcuate aperture edge except where said egg-shaped aperture meets said slot.

3. A terminal as recited in claim 1, said egg-shaped aperture being defined by an aperture edge extending along both beams and joining said beams at said base, said aperture edge being defined by a plurality of radii, wherein a majority of said radii commence in said aperture and a minority of said radii commence outside said aperture.

4. A terminal as claimed in claim 3, said aperture edge being defined by three pairs of different radii symmetrically arranged along a central longitudinal axis of said egg-shaped aperture.

5. A terminal as recited in claim 1, each half of said egg-shaped aperture being defined by a generally continuous arcuate edge being defined by at least three radii.

6. A terminal as recited in claim 5, each half of said egg-shaped aperture being defined by three arcuate edge portions forming said generally continuous arcuate aperture edge.

7. A terminal as recited in claim 1, said egg-shaped aperture being divided into two halves positioned on either side of said slot, each half of said egg-shaped aperture being defined by a first edge portion, a second edge portion and a third edge portion, said first edge portion positioned adjacent said slot and being defined by a first radius, said second edge portion positioned adjacent said first edge portion and being defined by a second radius, and said third edge portion positioned adjacent said second edge portion and being defined by a third radius, wherein said first and third radii commence in said aperture and said second radius commences outside said aperture.

8. A terminal as recited in claim 7, wherein said third radius is smaller than said first radius, and said first radius is smaller than said second radius.

9. A terminal as recited in claim 8, wherein said first edge portions of each half of said egg-shaped aperture oppose each other, said second edge portions of each half of said egg-shaped aperture oppose each other, and said third edge portions of each half of said egg-shaped aperture oppose each other.

10. A terminal as recited in claim 5, wherein said three different radii include a top radius, middle radius and bottom radius, said aperture being defined by the following radii ratios, 0.05<top radius/middle radius<0.28, and 1.3<top radius/bottom radius<4.3, and 0.1<top radius/height<0.35 in which the height is the dimension of the aperture measured from the upper most portion of the aperture to the lower most portion of the aperture.

11. An insulation displacement connector comprising:

a base;

a pair of alms extending upwardly from said base, each of said arms having an upper portion and a lower portion;

a first central opening extending between said arms and being located between the upper portions thereof, said first opening being defined by parallel sides and being adapted to receive an insulated conductor, to remove a portion of the insulation from the conductor and to deform the conductor between said two arms;

a second central opening located between the lower portions of said arms, said second opening being in communication with said first opening and having an upper portion with a first width dimension, a middle portion with a smaller second width dimension and a lower portion with a still smaller third width dimension; and said second opening being formed from three radii, a top radius in the upper portion, a middle radius in the middle portion and a bottom radius in the lower portion, and said second opening being defined by the following radii ratios:

0.05<top radius/middle radius<0.28, and 1.3<top radius/bottom radius<4.3, and 0.1<top radius/height<0.35 in which the height is the dimension of the second opening measured along its central longitudinal axis from an end of the first opening to the base.

12. A connector as claimed in claim 11 wherein:

said second opening is symmetrical about a central longitudinal axis and asymmetrical about a minor axis, said minor axis being disposed perpendicular to said central longitudinal axis.

13. A connector as claimed in claim 11 wherein:

said first opening is approximately equal in length to the length along the central longitudinal axis of said second opening.

14. A connector as claimed in claim 11 wherein:

said second opening has an egg-shaped elevational profile.

15. A connector as claimed in claim 11 wherein:

said two arms distribute stress in the connector induced by receipt of the insulative conductor to said arms and away from said base.

* * * * *